US005809710A

United States Patent [19]

Jungwirth et al.

[11] Patent Number: 5,809,710

[45] Date of Patent: Sep. 22, 1998

[54] METHOD OF TENSIONING A TENSION MEMBER COMPOSED OF A PLURALITY OF INDIVIDUAL ELEMENTS

[75] Inventors: Dieter Jungwirth, Bad Heilbrunn; Alto Mannhart, Munich, both of Germany

[73] Assignee: Dyckerhoff & Widmann Aktiengesellschaft, Munich, Germany

[21] Appl. No.: 716,579

[22] Filed: Sep. 19, 1996

[30] Foreign Application Priority Data

Sep. 30, 1995 [DE] Germany ..... 195 36 701.4

[51] Int. Cl.[6] ..... E04C 5/08

[52] U.S. Cl. ..... 52/223.1; 52/223.2; 52/223.3; 52/223.4; 52/223.8; 52/223.14; 73/587; 73/622; 14/22

[58] Field of Search ..... 52/223.1, 223.2, 52/223.3, 223.4, 223.8, 223.13, 223.14; 73/760, 700, 862.04, 587, 622, 594, 643; 14/18, 22, 21

[56] References Cited

U.S. PATENT DOCUMENTS

| | | | |
|---|---|---|---|
| 3,658,296 | 4/1972 | Yegge | 52/223.13 X |
| 4,023,242 | 5/1977 | Caro Roqueta | 52/223.13 X |
| 4,192,114 | 3/1980 | Jungwirth et al. | 52/223.13 |
| 4,449,855 | 5/1984 | Langwadt | 52/223.13 X |
| 4,819,393 | 4/1989 | Augoyard | 52/223.13 |
| 5,208,932 | 5/1993 | Muller | 14/22 X |
| 5,456,113 | 10/1995 | Kwun et al. | 73/587 |
| 5,457,994 | 10/1995 | Kwun et al. | 73/587 |
| 5,469,677 | 11/1995 | Luthi | 52/223.13 |

*Primary Examiner*—Christopher Todd Kent
*Assistant Examiner*—W. Glenn Edwards
*Attorney, Agent, or Firm*—Friedrich Kueffner

[57] ABSTRACT

A method of tensioning parallel prestressing members of a building or building component of prestressed concrete or a tension member composed of a plurality of individual elements, such as steel rods, steel wires or steel strands, wherein the individual elements are successively tensioned either individually or in groups. The tensioning method described above includes the steps of tensioning a first individual element or a group of individual elements until a predetermined tension is reached and anchoring the first individual element or group of individual elements; tensioning a second individual element or a group of individual elements until the tension thereof is equal to the tension of the previously tensioned individual element or elements at the same time and anchoring the second individual element or group of individual elements; and repeating the preceding step until all individual elements are tensioned and anchored.

7 Claims, 6 Drawing Sheets

II
16
15
17
14
19
9
13
12
11
11
10
10
8
7
7
5
4
3
2
1
6
A
B
C
D
II

METHOD OF TENSIONING A TENSION MEMBER COMPOSED OF A PLURALITY OF INDIVIDUAL ELEMENTS

BACKGROUND OF THE INVENTION

1. Field of the Invention

The present invention relates to a method of tensioning parallel prestressing members of a building or building component of prestressed concrete or a tension member composed of a plurality of individual elements, such as steel rods, steel wires or steel strands, wherein the individual elements are successively tensioned either individually or in groups.

2. Description of the Related Art

As a result of the precompressive strain introduced during the tensioning of the tension members, buildings or building components of prestressed concrete are subjected to deformations, particularly upsetting deformations which, when the prestessing members are tensioned successively either individually or in groups, lead to a decrease of the tension of the previously tensioned prestressing members. In order to achieve the result that all prestressing members have the same tension in the final state, conventional prestressing technology requires that the sequence of tensioning is determined ahead of time and the tension to be introduced into each tension member must be exactly computed while taking into consideration the deformations occurring as a result of each tensioning. Since particularly the assumptions to be made with respect to the deformations of a building are frequently uncertain, this complicated method not always results in a uniform distribution of tension.

The same is basically true also for free tension members, such as stay cables of cable-stayed bridges. Especially stay cables of cable-stayed bridges are frequently composed of one hundred or more individual elements which must be tensioned for achieving the condition of use. The application of the tension can be effected either by tensioning all individual elements simultaneously or by tensioning the individual elements successively. Due to the influence of the tension on the building, in the case of a cable-stayed bridge, for example, on the top of the tower and the girder supporting the roadway, deformations occur in the building which must be taken into consideration when applying the tension.

For tensioning the entire tension member, i.e., the simultaneous application of tension to all individual elements, very complicated large and correspondingly heavy hydraulic presses are required. However, the simultaneous application of tension has the advantage that the final tension can be easily correctly adjusted while taking into consideration the deformations of the building. If the individual elements are tensioned successively, the tensioning of a second and of all other individual elements causes the tension of the previously tensioned individual element or all previously tensioned individual elements to be reduced. This means that all individual elements except for the last one must be overtensioned by a certain force which is characteristic for each individual element. Consequently, it is necessary to compute in a complicated computation method the individual tension to be introduced into each individual element.

In this connection, it is already known in a tension member of steel wire strands to use the first tensioned strand as a "reference strand", to provide this reference strand with a force measuring device and then to tension each additional strand to that tension which the reference strand has at the moment when the additional strand is tensioned (EP 0 421 862 B1). In that case, it is necessary to compute on the basis of the expected deformations of the building the tension which is to be imparted on the first strand and which is greater than the final tension; however, since the tension inherent in the tensioned strands is always equal among these strands, the reference strand always reflects the tension inherent in the already tensioned strands.

For carrying out this method, two force measuring devices, such as pressure gauges, are required; one force measuring device is required for measuring the tension of the reference strand at all times and the second force measuring device is required for adjusting to the appropriate values the tensions of the respectively next strands to be tensioned. In addition, the reference strand must initially be anchored preliminarily relative to a support extending over the anchoring system and the tension of the reference strand must be released at the end of the entire tensioning process to be able to remove the pressure gauge provided for the reference strand, and the reference strand must then again be tensioned. The measuring instruments are sensitive and complicated.

SUMMARY OF THE INVENTION

Therefore, it is the primary object of the present invention to provide a simple and practical possibility for successively tensioning individually or in groups the prestressing members of a building or the individual elements of a free tension member.

In accordance with the present invention, the tensioning method described above includes the steps of tensioning a first individual element or a group of individual elements until a predetermined tension is reached and anchoring the first individual element or group of individual elements; tensioning a second individual element or a group of individual elements until the tension thereof is equal to the tension of the previously tensioned individual element or elements at the same time and anchoring the second individual element or group of individual elements; and repeating the preceding step until all individual elements are tensioned and anchored.

The present invention is based on the consideration that a tension introduced into a plurality of prestressing members or individual elements will be distributed uniformly over these members or elements. Accordingly, the invention provides that the tension of the tension member or individual element to be tensioned is directly compared to the previously tensioned and anchored individual element by applying the same press pressure to the presses used for tensioning.

This direct comparison of the tension can be carried out mechanically, for example, by means of a type of scale in which the previously tensioned tension member is anchored relative to an arm of a scale beam and the respectively next tension member to be tensioned is tensioned relative to the other arm of the scale beam; on the other hand, the direct comparison can also be carried out hydraulically, in the simplest case by using two individual tensioning presses which are connected to each other so as to communicate hydraulically.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
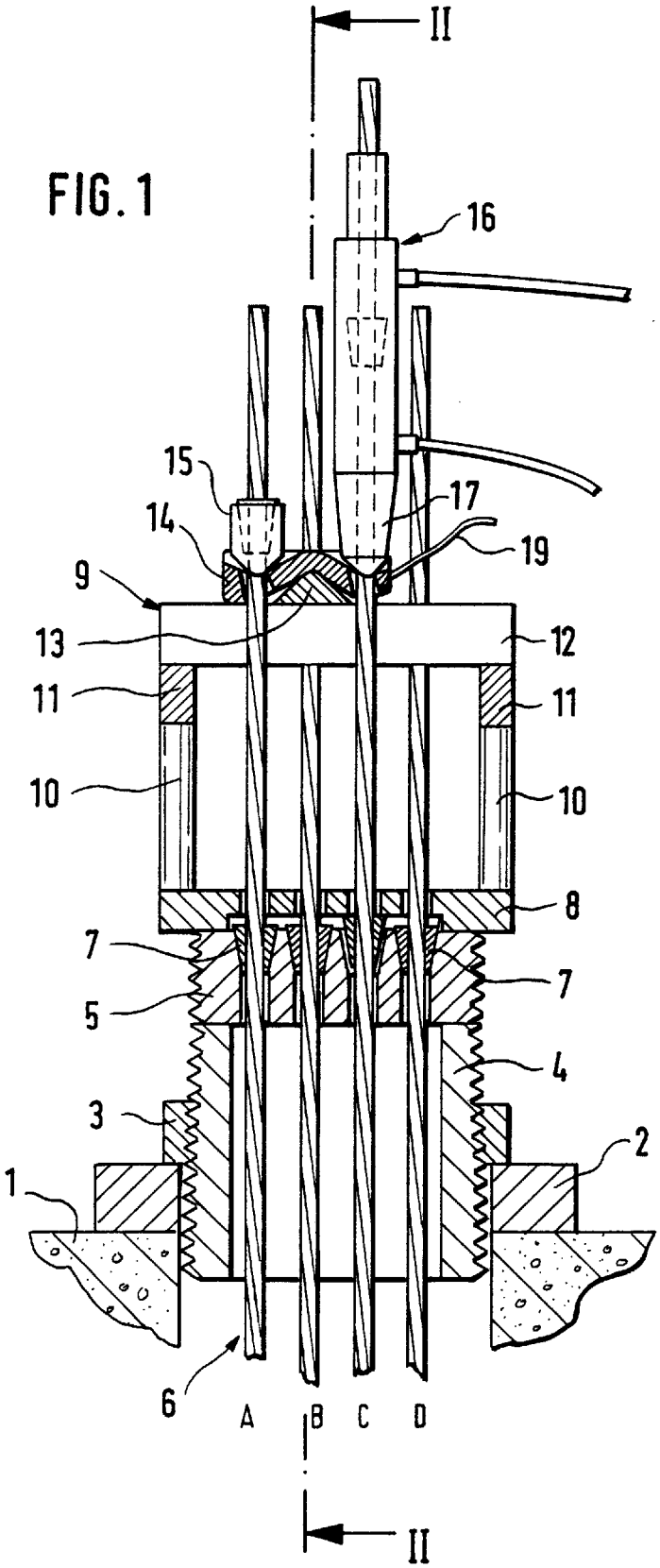
FIG. 1 is an elevational view, partially in section, of a tensioning device with a scale beam for use in the method according to the present invention.
Figure 2:
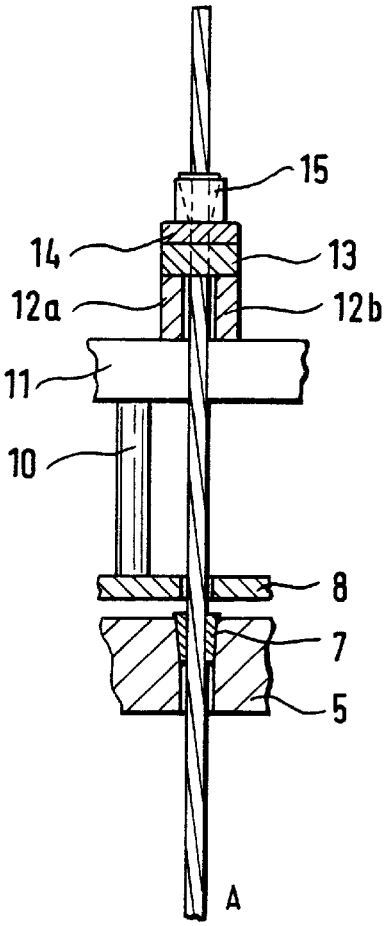
FIG. 2 is a sectional view of the tensioning device taken along sectional line II—II in FIG. 1.

FIGS. 1 and 2 of the drawing merely illustrate the principle of a mechanical scale used on two individual elements to be tensioned successively. Of course, the application of the invention is not limited to this example; rather, tension members or prestressed concrete components having any number of individual elements or prestressing members can be tensioned in this manner.

Figure 3:
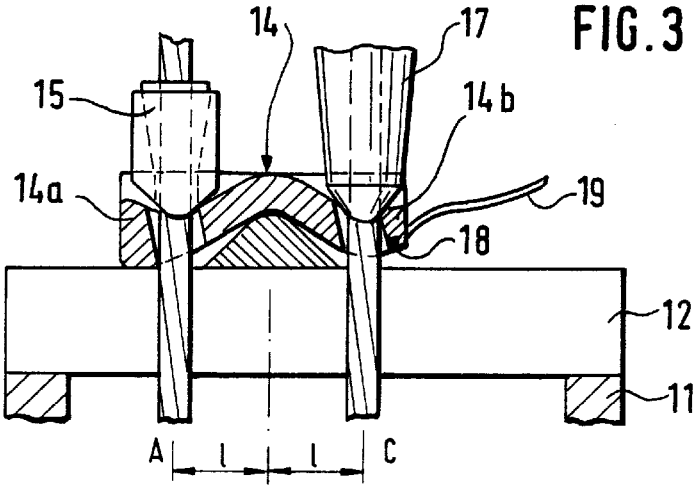
FIG. 3 is a sectional view, on a larger scale, of the scale beam.

In the illustrated embodiment, an abutment plate 2 rests against a building component 1. A sleeve 4 with an external thread rests against this abutment plate 2 through an annular bushing 3 having an internal thread; the sleeve 4 supports at its upper end an anchor disk 5. Four strands A, B, C and D symbolizing a tension member 6 can be anchored by means of wedges 7 in the anchor disk 5. A support 9 rests on the anchor disk 5 through a wedge retaining plate 8. The support 9 is composed of lateral support members 10 and transverse girders 11 extending over the support members 10. A support beam 12 extends over the transverse girders 11. The support beam 12 is composed of two parallel components 12*a* and 12*b* shown in FIG. 2, wherein the strands to be tensioned extend between the two parallel components 12*a* and 12*b*; in the illustrated embodiment, the strands to be tensioned are strands A and C. The support beam 12 supports on its upper side a wedge-shaped abutment 13 for a W-shaped scale beam 14 having two arms 14*a* and 14*b* shown in FIG. 3. The tip of the abutment wedge 13 is located at equal distances 1 from the axes of the strands A and C.

In the embodiment of FIG. 1, it is assumed that the strand A on the left hand side as seen in FIG. 1 has already been tensioned with the use of an individual tensioning press and is anchored relative to the arm 14*a* of the scale beam 14 by means of a wedge anchor 15. The tension introduced into the strand A had previously been computed taking into consideration the final deformation of building and tension member; the tension is always greater than the computer tension of the total tension member. The individual tensioning press 16 is then placed on strand C; the press 16 rests with its tensioning head 17 against the arm 14*b* of the scale beam 14. The anchoring wedges 7 for the final anchoring of the strands A and C have already been placed. During tensioning, the wedges 7 are held back by the wedge retaining plate 8; this is indicated in the wedge of the strand C.

As a result of the tension introduced into the strand A, the left arm 14*a* of the scale beam 14 stressed by this strand is pressed against the support beam. As soon as the tension introduced by means of the tensioning press 16 during tensioning of the strand C corresponds to the tension of the previously strand A, the scale beam 14 tilts about the tip of the abutment wedge 13. The tilting process may be indicated, for example, by a position sensor or an inductive proximity switch 18; weak current lines 19 lead to the hydraulic pump in order to switch off the hydraulic pump as soon as the switch 18 responds.

When the tension in the strand C is equal to the tension in the strand A, the tensions can be placed on the wedges 7 and the strands A and C can be anchored in this manner. After disassembling the temporary anchoring system 15 from the strand A and removing the tensioning press 16 from the strand C, the scale beam 14 can be tilted back, so that a next strand, for example, the strands B or D can be tensioned and the tension thereof can be compared to one of the previously tensioned strands, i.e., the strands A or C.

This procedure is repeated until all strands of the tension member have been tensioned. The particular advantage of the method according to the present invention is the fact that the tension of the strand to be tensioned is compared directly to the equal tensions of the previously tensioned strands. This not only makes it unnecessary to use complicated force measuring devices which must subsequently by removed again, but errors in reading these devices are prevented.

If necessary, by using the annular bushing 3 and the threaded sleeve 4, the tension of the entire tension member can be readjusted, for example, for a gradient correction.

FIGS. 4–7 illustrate another possibility according to the present invention for comparing the tension of an already tensioned strand to the tension of a strand to be tensioned; this embodiment utilizes a type of hydraulic scale.

Figure 4:
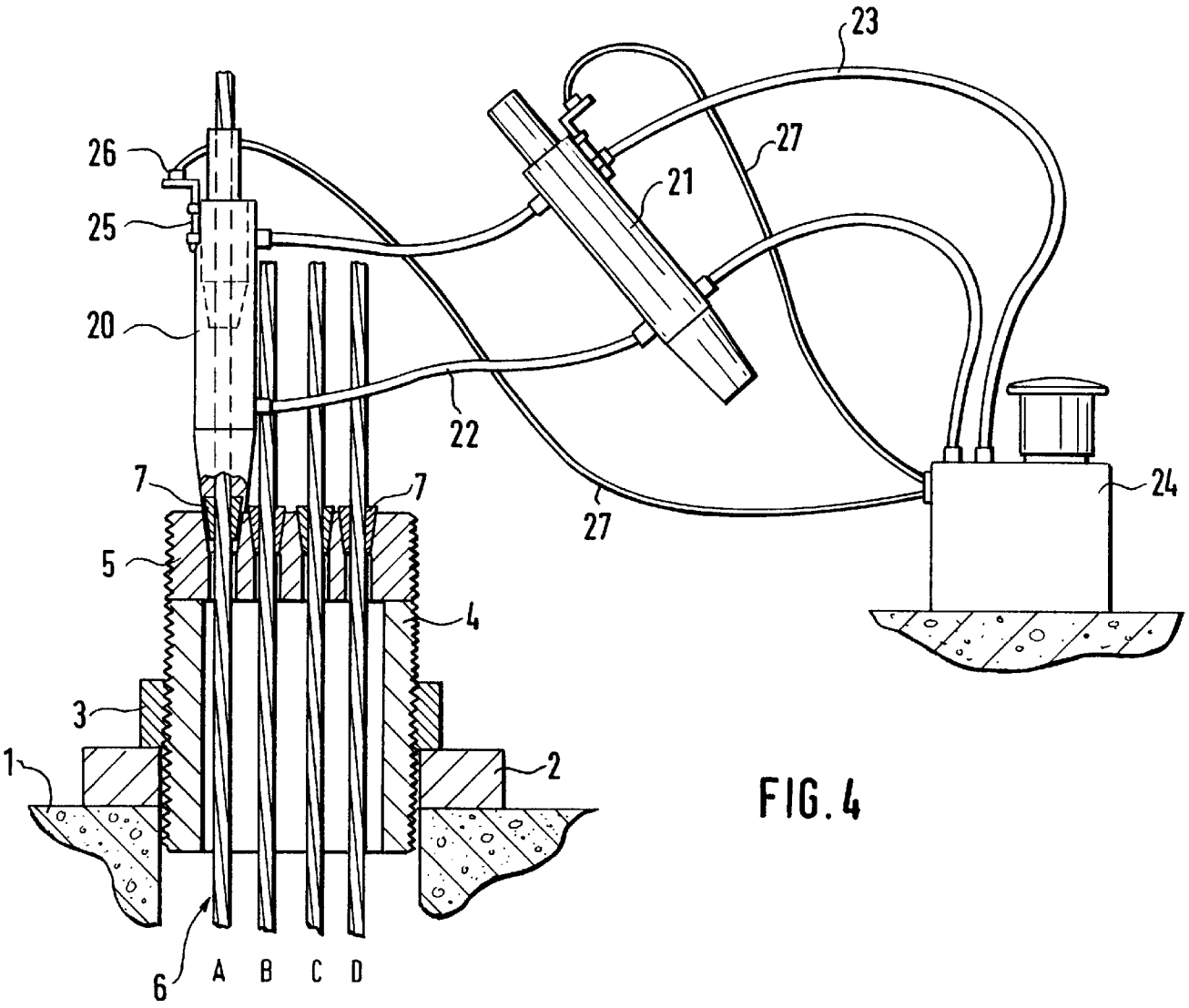
FIG. 4 is an elevational view, partially in section, of another embodiment of a tensioning device composed of two hydraulically connected individual tensioning presses for carrying out the method according to the present invention.

In FIG. 4, which shows the basic construction in a tensioning device composed of two individual tensioning presses 20 and 21, reference numeral 1 again indicates the structural component against which the abutment plate 2 rests and against which the anchoring disk 5 is supported through a threaded sleeve 4 and threaded bushing 3. The individual elements of the tension member 6 are again symbolized by four strands A, B, C and D.

The two presses 20 and 21 are each connected to a hydraulic pump 24 through a feed line 22 and a return line 23. In the illustrated embodiment, the press 20 is in contact with the strand A. By bypassing the press 21, only the press 20 is actuated; the press piston is pushed out, and the strand A is tensioned. Tensioning of the strand A takes place against the—final—anchoring disk 5 up to a tension which has been predetermined by computation and which is greater than the computed tension of the entire tension member 6 and takes into consideration the final deformation of building and tension member 6. After tensioning, the strand A is anchored; for this purpose, the annular wedge 7 can be driven in by means of a wedging piston integrated in the press 20.

Figure 5:
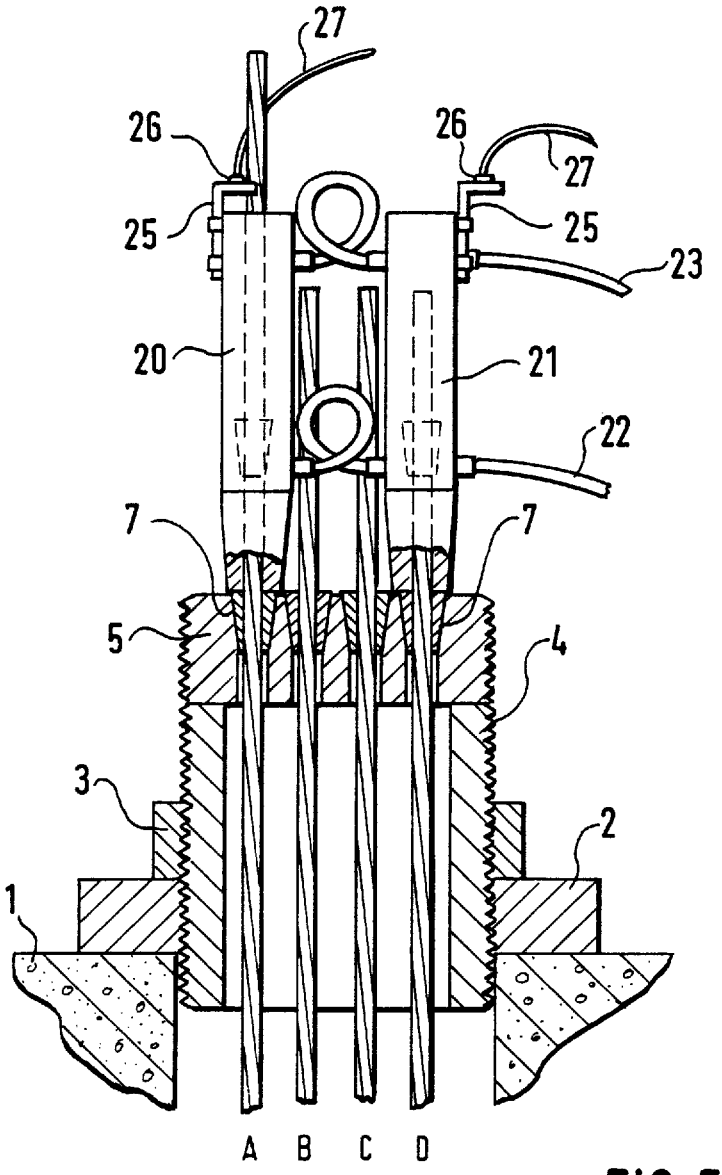
FIGS. 5–7 show successive phases of a tensioning procedure using the tensioning device according to FIG. 4.
Figure 6:
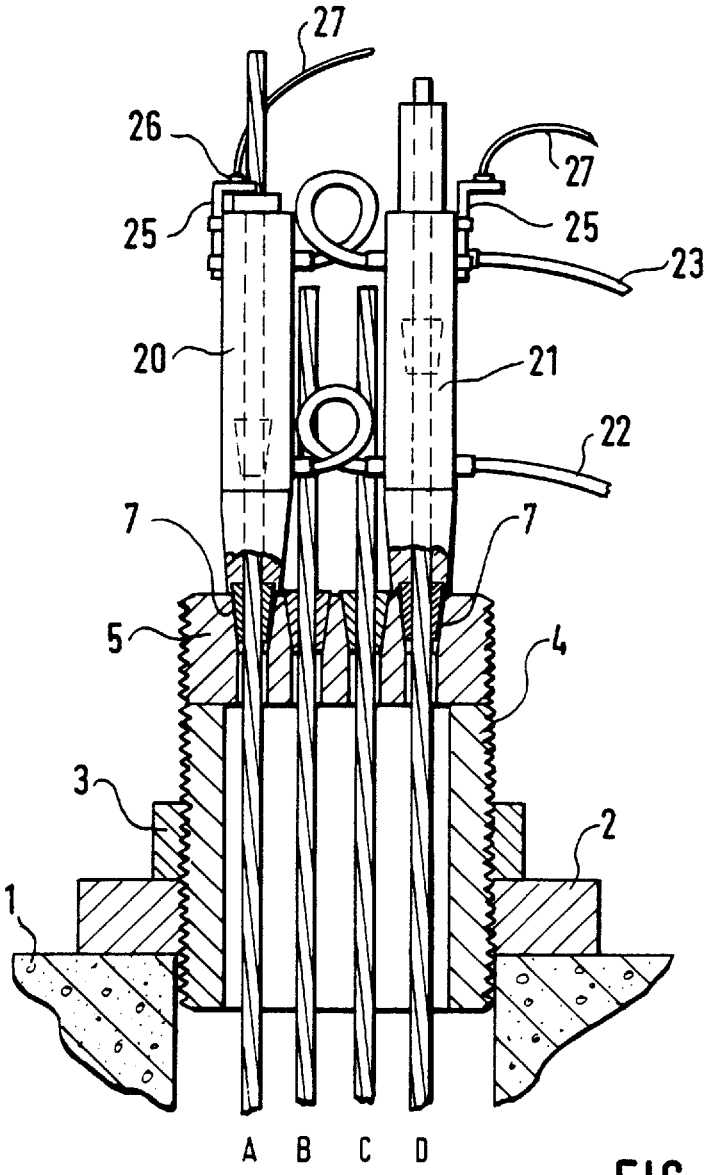
Figure 7:
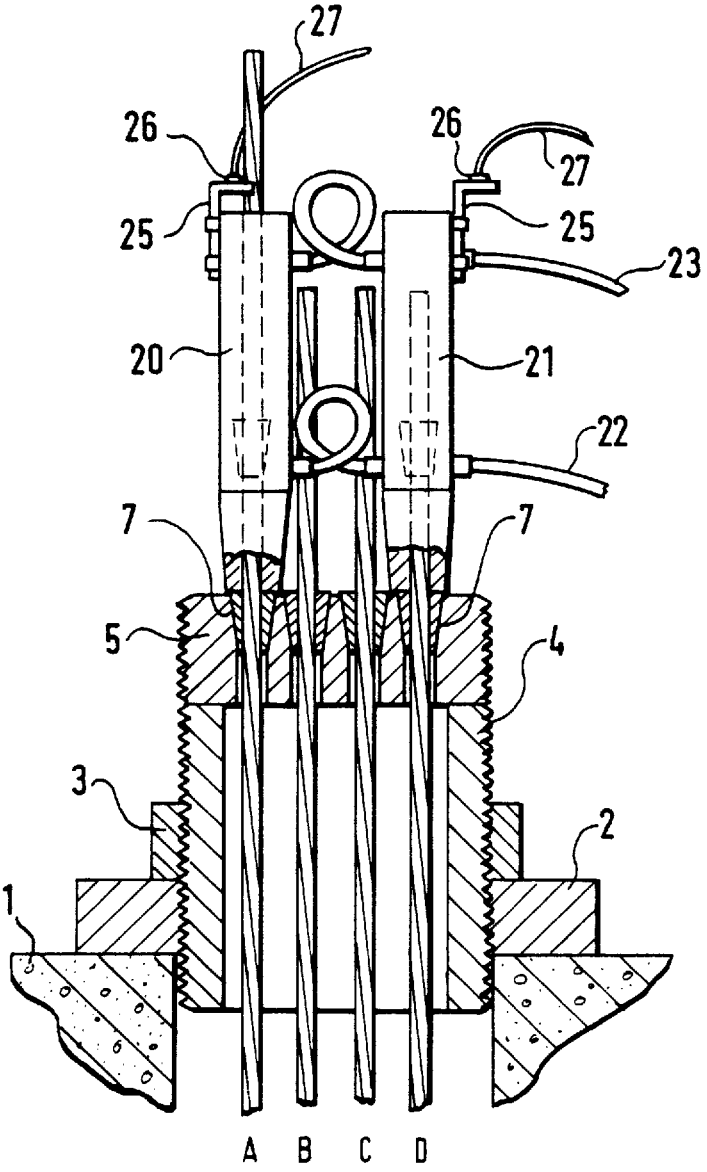

In the next method step shown in FIG. 5, the press 21 is placed, for example, on the strand D while leaving the press 20 in place; the press 20 remains in contact with the strand A or the anchoring system thereof. When actuating the press 21 while maintaining a hydraulically communicating connection between the presses 21 and 20 through the lines 22 or 23, the piston of the press 20 is moved out by a small distance when the tension is equal to the tension already introduced to the strand A and, thus, the fact is signalized that the tensions of both strands A and D are equal, as shown in FIG. 6. It is important in this connection that when the press 20 is moved out, the annular wedge 7 which is slightly loosened may not change its position relative to the strand A. When both presses 20 and 21 are deactivated at this stage, the two annular wedges 7 slide into the bores of the anchoring disk 5 and form the final anchoring system in this manner. The same steps are then repeated with the remaining strands.

In order not to have to rely on an external observation of the presses 20 and 21, it is possible to arrange switches 26, such as a position sensor or an inductive proximity switch, on swingable brackets 25 at the presses 20 and 21. For tensioning, the brackets 25 can be swung out, as shown, for example, at press 21 in FIG. 5; for indicating the movement of the press at an already tensioned strand, the bracket 25 can be swung in, as shown, for example, at press 20 in FIG. 5. The switches 26 can be connected directly to the pump 24 through weak current lines 27 in order to switch off the pump when the appropriate tension has been reached.

The tensioning procedure is not limited to the use of two hydraulic presses as shown in the drawings; rather, by using an appropriate number of individual tensioning presses which are connected to each other so as to be in communication, it is also possible to tension groups of strands.

In addition, it is also possible to carry out the first tensioning procedure with n presses, and not with n−1 presses as shown in FIG. 4, i.e., with only one of two presses. However, it is then necessary that the next tensioning procedure or all additional tensioning procedures are carried out while leaving a press at an already tensioned strand with n−1 presses.

The invention is not limited by the embodiments described above which are presented as examples only but can be modified in various ways within the scope of protection defined by the appended patent claims.

I claim:

1. A method of tensioning parallel prestressing members of a building or building component of prestressed concrete or of a tension member composed of a plurality of individual elements, selected from the group consisting of steel rods, steel wires or steel strands, wherein the individual elements are tensioned successively either individually or in groups, the method comprising the steps of a) tensioning a first individual element or group of individual elements to a predetermined tension;

b) anchoring the first individual element or group of individual elements;

c) tensioning a second individual element or group of individual elements until a tension thereof is equal to a tension of the first individual element or group of individual elements;

d) anchoring the second individual element or group of individual elements; and e) repeating steps c) and d) until all individual elements are tensioned and anchored, further comprising anchoring the first individual element relative to an arm of a scale beam and tensioning the second individual element to another arm of the scale beam.

2. The method according to claim 1, comprising directly comparing the tension of an individual element or group of individual elements with a previously tensioned and anchored individual element or group of individual elements.

3. A method of tensioning parallel prestressing members of a building or building component of prestressed concrete or of a tension member composed of a plurality of individual elements, selected from the group consisting of steel rods, steel wires or steel strands, wherein the individual elements are tensioned successively either individually or in groups, the method comprising the steps of a) tensioning a first individual element or group of individual elements to a predetermined tension;

b) anchoring the first individual element or group of individual elements;

c) tensioning a second individual element or group of individual elements until a tension thereof is equal to a tension of the first individual element or group of individual elements;

d) anchoring the second individual element or group of individual elements; and e) repeating steps c) and d) until all individual elements are tensioned and anchored, further comprising using individual tensioning presses for tensioning the individual elements, wherein the individual tensioning presses are connected to each other so as to be hydraulically communicating, and leaving an individual tensioning press at a previously tensioned individual element when tensioning the second individual element or subsequent individual elements.

4. An arrangement for tensioning parallel prestressing members of a building or building component of prestressed concrete or of a tension member composed of a plurality of individual elements selected from the group consisting of steel rods, steel wires and steel strands, wherein the individual elements are tensioned successively either individually or in groups, by carrying out the steps of a) tensioning a first individual element or group of individual elements to a predetermined tension;

b) anchoring the first individual element or group of individual elements;

c) tensioning a second individual element or group of individual elements until a tension thereof is equal to a tension of the first individual element or group of individual elements;

d) anchoring the second individual element or group of individual elements; and e) repeating steps c) and d) until all individual elements are tensioned and anchored;

the arrangement comprising a scale beam having first and second arms, a wedge-shaped abutment supporting the scale beam, the first arm of the scale beam receiving the first individual element and the second arm of the scale beam receiving the second individual element, and one of a tensioning press or anchoring device being placeable against each arm of the scale beam.

5. The arrangement according to claim 4, wherein the scale beam is approximately W-shaped.

6. The arrangement according to claim 4, further comprising an anchoring disk for anchoring the individual elements, and a support means supported by the anchoring disk, the support means comprising a support beam for supporting the scale beam.

7. An arrangement for tensioning parallel prestressing members of a building or building component of prestressed concrete or of a tension member composed of a plurality of individual elements selected from the group consisting of steel rods, steel wires and steel strands, wherein the individual elements are tensioned successively either individually or in groups, by carrying out the steps of a) tensioning a first individual element or group of individual elements to a predetermined tension;

b) anchoring the first individual element or group of individual elements;

c) tensioning a second individual element or group of individual elements until a tension thereof is equal to a tension of the first individual element or group of individual elements;

d) anchoring the second individual element or group of individual elements; and e) repeating steps c) and d) until all individual elements are tensioned and anchored;

the arrangement comprising at least two hydraulic individual tensioning presses attachable to the individual elements, the individual tensioning presses being in hydraulic communication with each other and with a hydraulic pump through a feed line and a return line.

* * * * *